US006467419B2

(12) United States Patent
Hori

(10) Patent No.: US 6,467,419 B2
(45) Date of Patent: Oct. 22, 2002

(54) UPPER THREAD CASSETTE AND UPPER THREAD CHANGING DEVICE

(75) Inventor: Masayuki Hori, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/960,921

(22) Filed: Sep. 25, 2001

(65) Prior Publication Data

US 2002/0035956 A1 Mar. 28, 2002

(30) Foreign Application Priority Data

Sep. 26, 2000 (JP) ..... 2000-291850

(51) Int. Cl.[7] ..... D05B 43/00; D05B 59/00; D05B 65/02

(52) U.S. Cl. ..... 112/302; 112/293

(58) Field of Search ..... 112/80.7, 293, 112/163, 168, 302, 254, 259; 242/171, 334, 337, 324.2, 326.2, 338, 410, 563, 566, 150 R; D14/164

(56) References Cited

U.S. PATENT DOCUMENTS 3,749,039 A * 7/1973 Fritts ..... 112/302
4,183,313 A * 1/1980 Odermann et al. ..... 112/302
4,579,615 A 4/1986 Hanyu et al.
5,063,866 A * 11/1991 Jimenez et al. ..... 112/302
5,762,012 A * 6/1998 Kawamura et al. ..... 112/163
5,913,485 A * 6/1999 Bruffett ..... 112/302
6,160,679 A * 12/2000 Maekawa et al. ..... 242/338 X

FOREIGN PATENT DOCUMENTS

CH 405897 * 7/1966 ..... 112/302
JP A 26-50261 5/1997
JP A 9-302571 11/1997

* cited by examiner

*Primary Examiner*—Ismael Izaguirre
(74) *Attorney, Agent, or Firm*—Oliff & Berridge, PLC

(57) ABSTRACT

An upper thread cassette includes a cassette member having a cassette body formed of synthetic resin material and a cassette cover that opens or closes the cassette body, a thread wound member mounting part that mounts thereon a thread wound member winding an upper thread therearound and is provided inside the cassette member, a cutting mechanism that cuts the upper thread supplied from the thread wound member mounted on the thread wound member mounting part, and a thread end holding member that holds an end of the upper thread cut by the cutting mechanism.

30 Claims, 9 Drawing Sheets

UPPER THREAD CASSETTE AND UPPER THREAD CHANGING DEVICE

BACKGROUND OF THE INVENTION

1. Field of Invention

The invention relates to an upper thread cassette and an upper thread changing device. More particularly, it relates to an upper thread cassette and an upper thread changing device that facilitate the performance of upper thread changing operations, such as when a color of an upper thread is changed during sewing operations.

2. Description of Related Art

Before starting sewing operations with a conventional sewing machine, some preparation is required. For example, a thread spool having a thread of a desirable color wound therearound is set to the sewing machine. An upper thread is pulled out of the thread spool and threaded on some mechanisms of the sewing machine, such as a thread guide, a thread tension guide, and a thread take-up. The upper thread is then passed through a needle eye. Especially when embroidering operations are performed for an embroidery pattern that requires a plurality of threads of different colors, an operator has to repeatedly perform the troublesome operations of setting thread spools on the sewing machine and threading upper threads on the above-described mechanisms of the sewing machine, as well as threading a needle, every time the embroidering operations with one color of the upper thread is finished and the color of the upper thread is changed to another.

In recent years, thread connecting devices, such as those described in U.S. Pat. No. 4,579,615 and Japanese Laid-Open Patent Publication No. 9-302571, that connect an end of a thread wound around one thread spool selected from a plurality of thread spools and an end of a thread threaded onto a sewing machine, are put into practical use. In the thread connecting device disclosed in U.S. Pat. No. 4,579,615, a thread connecting means cuts an upper thread, and holds an end of the upper thread belonging to or threaded onto a sewing machine and an end of an upper thread of a desirable color belonging to or wound around a thread spool, at a predetermined position. The thread connecting means connects the thread ends, through the medium of a connecting thread, by melting.

In a thread connecting device disclosed in Japanese Laid-Open Patent Publication No. 9-302571, vacuuming with a tube is started so as to move a thread clamp and a wiper toward a needle. After an end of an upper thread is clamped between an inner wall of the thread clamp and a vacuum ball, a hook and the thread clamp are moved by a cylinder toward an index. The vacuuming is stopped to return the thread clamp and the wiper to their original positions.

The clamped thread end is moved toward gears and the upper thread is drawn. Thereafter, the hook capturing the thread retracts. The distance between a pair of the gears is closed by the cylinder. An electric current is passed through a heating wire of a thread cutter and the upper thread is cut. Then, a knotter is moved by the cylinder to a thread knotting position. After the cylinder closes a tension disc, the thread knotting operations are performed by the cylinder.

In the conventional thread connecting device that employs thread spools, an upper thread is often pulled out of a thread spool to be longer than it needs to be, due to a reaction force of the thread wound around the thread spool (the force resulting as the thread tries to separate from the thread spool), resulting in slack in the upper thread in a path of the upper thread leading from the thread spool to a thread guide. Such slack causes the upper thread to get twisted, entangled, or overlapped, which leads to non-uniform upper thread tension. Consequently, the upper thread and an under thread are not properly tensioned, resulting in poor-looking stitches. In worse cases, the thread or a needle is broken.

As disclosed in Japanese Patent No.2650261, such an upper thread cassette containing an upper thread that applies uniform tension to the upper thread to be drawn and prevents the upper thread from being entangled is proposed and put into practical use. The upper thread cassette disclosed in Japanese Patent No. 2650261 includes a cassette body, a thread accommodating hole, an upper thread wound around an upper thread bobbin which is to be accommodated in the thread accommodating hole, an "L"-shaped plate spring, a pin, and a plurality of notches. While tension is applied to the upper thread by holding the upper thread between the plate spring and the pin, the upper thread is pulled through a thread pull-out hole. The tension applied to the upper thread is adjustable by engaging a protrusion of the plate spring with a different one of the notches.

Problems with the thread connecting devices disclosed in U.S. Pat. No. 4,579,615 and Japanese Laid-Open Patent Publication No. 9-302571, are they are expensive and they consist of large-sized devices having complicated structures.

In the conventional upper thread cassette disclosed in Japanese Patent No. 2650261, when a color of an upper thread is changed to a different color during sewing operations, the upper thread is cut and the upper thread cassette has to be removed from the sewing machine. Then, another upper thread cassette containing an upper thread of desirable color is set to the sewing machine, followed by the operations of threading the upper thread on a thread guide, a thread tension guide, and a thread take-up, and threading a needle. Thus, changes of upper thread colors require the troublesome operations.

In addition, when the upper thread cassette is not mounted, the upper thread needs to protrude, after cutting, from the upper thread cassette by an appropriate length, as a preparation for the next use (for the cassette remounting), so that a pressing force exerted between the plate spring and the pin needs to be set to high, to prevent the upper thread in the cassette from being excessively pulled out. When the upper thread cassette is mounted, the upper thread necessary for the sewing operations with the sewing machine has to be pulled from the upper thread cassette, so that the pressing force exerted between the plate spring and the pin needs to be set to low.

SUMMARY OF THE INVENTION

The invention provides an upper thread cassette and an upper thread changing device that facilitate upper thread changing operations to be performed, such as when a color of an upper thread is changed during sewing operations, as well as the upper thread changing device having a simplified structure so as to achieve a reduction in the size of the device.

According to one aspect of the invention, there is provided an upper thread cassette that contains an upper thread for use in sewing. The upper thread cassette may include a cassette member including a cassette body and a cassette cover that opens or closes the cassette body, a thread wound member mounting part that mounts thereon a thread wound member winding the upper thread therearound and is provided inside the cassette member, and a cutting mechanism that cuts the upper thread supplied from the thread wound member mounted on the thread wound member mounting part.

In the upper thread cassette of the invention, the thread wound member winding the upper thread therearound may be mounted on the thread wound member mounting part provided inside the cassette member. From the upper thread cassette, an end of the upper thread may be pulled out. Then, the cassette cover may be closed. The upper thread supplied from the thread wound member mounted on the thread wound member mounting part may be cut by the cutting mechanism. With the above-described structures, a pair of scissors or another cutter does not have to be prepared to cut the upper thread. Therefore, thread cutting operations may be improved.

The upper thread cassette may further include a thread end holding member that holds an end of the upper thread cut by the cutting mechanism. Because the cut upper thread may be held by the thread end holding member, an end of the upper thread does not have to be pulled out of the upper thread cassette every time the upper thread cassette is mounted. Consequently, the operation of changing a color of the upper thread during sewing operations is facilitated.

In the upper thread cassette, the cutting mechanism may cut the upper thread such that a cut end of the upper thread protrudes from the thread end holding member by a predetermined length. This structure may enable upper thread changing operations for changing a color of the upper thread to be automatically conducted by, for example, an upper thread changing device. Further, the upper thread may be prevented from unintentionally being released from the thread end holding member, being tangled, or being pulled into the upper thread cassette.

The cassette member may have an outlet that leads the end of the upper thread supplied from the thread wound member mounted on the thread wound member mounting part outside the cassette member. The thread end holding member and the cutting mechanism may be provided near the outlet, so that the upper thread may be cut by the cutting mechanism with an end thereof protruding outwardly from the cassette member, while preventing slack in the upper thread or the entanglement thereof.

Because the upper thread cassette may further include a tension applying mechanism that applies tension to upper thread supplied from the thread wound member mounted on the thread wound member mounting part, the tension may be applied to the upper thread supplied from the thread wound member by the tension applying mechanism.

As the upper thread cassette may further include a tension release operation part that releases the tension applied by the tension applying mechanism by externally operating the tension applying mechanism, the tension applied to the upper thread may be released by the tension release operation part. With this structure, the upper thread may readily be let out of the upper thread cassette.

The thread end holding member may serve as the tension applying mechanism. In other words, the end of the upper thread may be held by applying tension to the upper thread supplied from the thread wound member.

The thread wound member to be mounted on the thread wound member mounting part may include an upper thread bobbin having a narrow width provided in a direction of an axis thereof, relative to a diameter of the upper thread bobbin. The thread wound member mounting part may rotatably mount the upper thread bobbin thereon. With such a structure, the width of the upper thread cassette and, consequently, the size of the upper thread cassette may be reduced. The upper thread cassette may further include a brake mechanism that applies a brake to the upper thread bobbin mounted on the thread wound member mounting part. By applying the brake to the upper thread bobbin by the brake mechanism, rotation of the bobbin may be prevented.

Because the upper thread cassette may further include a brake releasing member that releases the brake applied by the brake mechanism by operating the brake mechanism outside the cassette member, the brake applied by the brake mechanism may be released with the brake releasing member by operating the brake mechanism outside the cassette member.

The thread wound member to be mounted on the thread wound member mounting part may include a thread spool. An existing thread spool may be applied as the thread wound member. The thread spool winding the upper thread therearound may be mounted on the thread wound member mounting part.

The upper thread cassette may further include a supporting shaft that pivotally supports the thread spool and is provided inside the cassette member, a shaft supporting member that fixedly supports the supporting shaft at an end thereof and is provided inside the cassette member, and a connecting mechanism that connects the shaft supporting member and the supporting shaft to the cassette member so as to allow the shaft supporting member and the supporting shaft to pivot in a range between a thread spool accommodating position where the thread spool is accommodated inside the cassette member, and a thread spool changing position where the supporting shaft is pivoted, as the cassette cover is opened, from the thread spool accommodating position to a position in which the supporting shaft is kept at an angle so as to enable the thread spool to be exchanged.

With the cassette cover open, the supporting shaft and the shaft supporting member may pivotally be moved with the connecting mechanism, to the thread spool changing position. In the thread spool changing position, the thread spool may be supported by the supporting shaft. Thereafter, the thread spool supported by the supporting shaft may pivotally be moved with the connecting mechanism to the thread spool accommodating position, together with the supporting shaft and the shaft supporting member. Then, the cassette cover may be closed. Thus, the upper thread cassette may be readied for use in sewing.

The upper thread cassette may further include a thread spool presser that is removably provided so as to press the thread spool pivotally supported by the supporting shaft. The thread spool presser may have a plurality of guide grooves that guide the upper thread and are formed on an outer edge thereof. After the thread spool is pivotally supported by the supporting shaft in the thread spool changing position, the thread spool presser may be mounted on the supporting shaft to press the thread spool. The upper thread supplied from the thread spool may be guided by the guide grooves of the thread spool presser, so that occurrences of slack in the upper thread or a twisted, entangled, or overlapped upper thread are prevented.

The thread spool presser may include a fixed part that is fixed on the supporting shaft and a movable part that is supported so as to move relative to the fixed part. The plurality of the guide grooves may be formed on an edge of the movable part. As the upper thread is supplied from the thread spool, the movable part may move while guiding the upper thread with one of the plurality of the guide grooves.

Therefore, the occurrences of slack in the upper thread or a twisted, entangled, or overlapped upper thread may be reliably prevented.

The cassette member may be partially or totally formed of transparent material that enables the upper thread wound around the thread wound member set in the upper thread cassette to be visually identified. With this structure, a color and a remaining amount of the upper thread wound around the thread wound member may be visually identified outside the cassette member.

The cassette member and the upper thread bobbin may be partially or totally formed of transparent material that enables the upper thread wound around the upper thread bobbin set in the upper thread cassette to be visually identified. With this structure, a color and a remaining amount of the upper thread wound around the upper thread bobbin may be visually identified outside the cassette member.

The upper thread cassette may be mounted to an upper thread changing device that selectively supplies upper threads of a plurality of colors for embroidering. Therefore, embroidering may be performed by selectively supplying the upper thread of a desirable color from one of the upper thread cassettes for a plurality of colors mounted on the upper thread changing device.

The upper thread cassette may be mounted to a position on an arm of a sewing machine. Therefore, sewing operations may be performed by mounting the upper thread cassette, containing the upper thread of a desirable color, at an appropriate position on the arm of the sewing machine.

According to another aspect of the invention, there is provided an upper thread changing device that selectively supplies to a sewing machine upper threads of a plurality of colors for embroidering. The upper thread changing device may include a plurality of upper thread cassettes, each of which contains an upper thread of a different color, cassette mounting sections that detachably mount the plurality of the upper thread cassettes thereon, and a changing mechanism that changes positions of the cassette mounting sections so as to place any one of the plurality of the upper thread cassettes mounted on the cassette mounting sections to an upper thread supply position to supply the upper thread to the sewing machine.

In the upper thread changing device of the invention, the plurality of the upper thread cassettes may be mounted on the cassette mounting sections. The positions of the cassette mounting sections may be changed by the changing mechanism so as to place any one of the plurality of the upper thread cassettes mounted on the cassette mounting sections, to an upper thread supply position to supply the upper thread to the sewing machine. Thus, a colored upper thread in the upper thread cassette may be supplied to the sewing machine.

In the upper thread changing device, the upper thread cassette may include a cassette member that includes a cassette body formed of synthetic resin material and a cassette cover that opens or closes the cassette body, a thread wound member mounting part that mounts thereon a thread wound member winding the upper thread therearound and is provided inside the cassette member, a cutting mechanism that cuts the upper thread supplied from the thread wound member mounted on the thread wound member mounting part, and a thread end holding member that holds an end of the upper thread cut by the cutting mechanism.

The thread wound member winding the upper thread therearound may be mounted on the thread wound member mounting part provided inside the cassette member. From the upper thread cassette, an end of the upper thread may be pulled out. Then, the cassette cover may be closed. The upper thread supplied from the thread wound member may be cut by the cutting mechanism. The end of the cut upper thread may be held by the thread end holding member. Thereafter, the upper thread cassette may be mounted on the upper thread changing device to start sewing operations.

According to another aspect of the invention, there is provided an upper thread cassette that is detachably mounted on a sewing machine or an upper thread changing device for selectively supplying upper threads of a plurality of colors for sewing. The upper thread cassette may include a cassette member that includes a cassette body and a cassette cover that opens or closes the cassette body, a thread wound member mounting part that rotatably and detachably mounts thereon a thread wound member winding an upper thread therearound and is provided inside the cassette member, and a rotation controlling member that controls rotation of the thread wound member. Because the rotation controlling member may control the rotation of the thread wound member rotatably mounted on the thread wound member mounting part, the thread wound member may be prevented from rotating, for example, when the thread wound member does not have to supply the upper thread.

The upper thread cassette may further include a contacted part that makes contact with a contact part provided in the sewing machine or the upper thread changing device. The rotation controlling member may allow the thread wound member to rotate as the contacted part makes contact with the contact part when the cassette member is mounted on the sewing machine or the upper thread changing device. The rotation controlling member may prevent the thread wound member from rotating when the cassette member is not mounted on the sewing machine or the upper thread changing device.

The cassette member may include a guide section that guides an installation of the upper thread cassette onto the sewing machine or the upper thread changing device. Therefore, the upper cassette may be readily mounted onto the sewing machine or the upper thread changing device while being guided by the guide section.

According to another aspect of the invention, there is provided an upper thread cassette that is detachably mounted on a sewing machine or an upper thread changing device for selectively supplying upper threads of a plurality of colors for sewing. The upper thread cassette may include a cassette member that includes a cassette body and a cassette cover that opens or closes the cassette body, a thread wound member mounting part that mounts thereon a thread wound member winding an upper thread therearound provided inside the cassette member, an outlet that leads an end of the upper thread supplied from the thread wound member mounted on the thread wound member mounting part to the outside of the cassette member also provided in the cassette member, a cutting mechanism that cuts the upper thread supplied from the thread wound member such that a cut end of the upper thread protrudes from the outlet by a predetermined length, and a thread end holding member that holds the end of the upper thread cut by the cutting mechanism.

When the upper thread cassette is not mounted on the sewing machine or the upper thread changing device, the end of the upper thread pulled out from the thread wound member mounted on the thread wound member mounting part may be cut by the cutting mechanism, so that the cut end of the upper thread protrudes by a predetermined length from the outlet. The cut end of the upper thread is held by the thread end holding member. Then, the upper thread cassette may be mounted on the sewing machine or the upper thread changing device.

The cassette member may include a protective cover movable between a cassette mounted position where the cassette member is mounted on the sewing machine or the upper thread changing device and a cassette non-mounted position where the cassette member is not mounted on the sewing machine or the upper thread changing device. In the cassette non-mounted position, the protective cover may cover the cut end of the upper thread that protrudes. In the cassette mounted position, the protective cover may move away from the cut end of the upper thread.

Because the protective cover in the cassette non-mounted position may cover the cut end of the upper thread that protrudes by a predetermined length from the outlet, the cut end of the upper thread may not be exposed. In the cassette mounted position, the protective cover may move away from the cut end of the upper thread, so that the cut end of the upper thread may be exposed.

The cutting mechanism may include a cutter blade and a holder that holds the cutter blade. The holder may form the protective cover. In the cassette nonmounted position, the cutter blade may cut the upper thread and the holder of the cutting mechanism may cover the cut end of the upper thread that protrudes.

According to another aspect of the invention, there is provided an upper thread cassette that is detachably mounted on a sewing machine or an upper thread changing device for selectively supplying upper threads of a plurality of colors for sewing. The upper thread cassette may include a cassette member that includes a cassette body and a cassette cover that opens or closes the cassette body, a thread wound member mounting part that mounts thereon a thread wound member winding an upper thread therearound provided inside the cassette member, an outlet that leads an end of the upper thread supplied from the thread wound member to the outside of the cassette member to supply the upper thread to the sewing machine or the upper thread changing device, and a tension applying mechanism that applies tension to the upper thread supplied from the thread wound member.

In the upper thread cassette of the invention, tension may be applied by the tension applying mechanism to the upper thread to be led outside the cassette member. Therefore, the upper thread may not be excessively supplied to the sewing machine or the upper thread changing device. Thus, the occurrence of slack in the upper thread or a twisted, entangled, or overlapped upper thread is prevented.

The tension applying mechanism may be a thread holding member that is provided near the outlet and holds the upper thread led through the outlet. Therefore, while the upper thread is being held by the thread holding member near the outlet, tension may be applied to the upper thread led through the outlet.

The thread holding member may serve as a thread end holding member that holds the end of the upper thread led through the outlet. In other words, by holding the upper thread with the thread holding member, the end of the upper thread led through the outlet may be held securely.

Because the upper thread cassette may further include a tension release operation part that releases the tension applied by the tension applying mechanism by externally operating the tension applying mechanism, the tension applied to the upper thread may be released by the tension release operation part. With this structure, the upper thread may be readily let out of the upper thread cassette.

BRIEF DESCRIPTION OF THE DRAWINGS

An exemplary embodiment of the invention will be described in detail with reference to the following figures wherein.

Further objects, details, and advantages of the invention will be apparent from the following detailed description, when read in conjunction with the drawings.

DETAILED DESCRIPTION OF PREFERRED EMBODIMENTS

An exemplary embodiment of the invention will be described in detail with reference to the accompanying drawings. An upper thread changing device 1, according to an exemplary embodiment of the invention, selectively supplies, for sewing operations, such as embroidering operations, upper threads 2 of different colors, each of which is included in an upper thread cassette 3, to a sewing machine.

Figure 1:
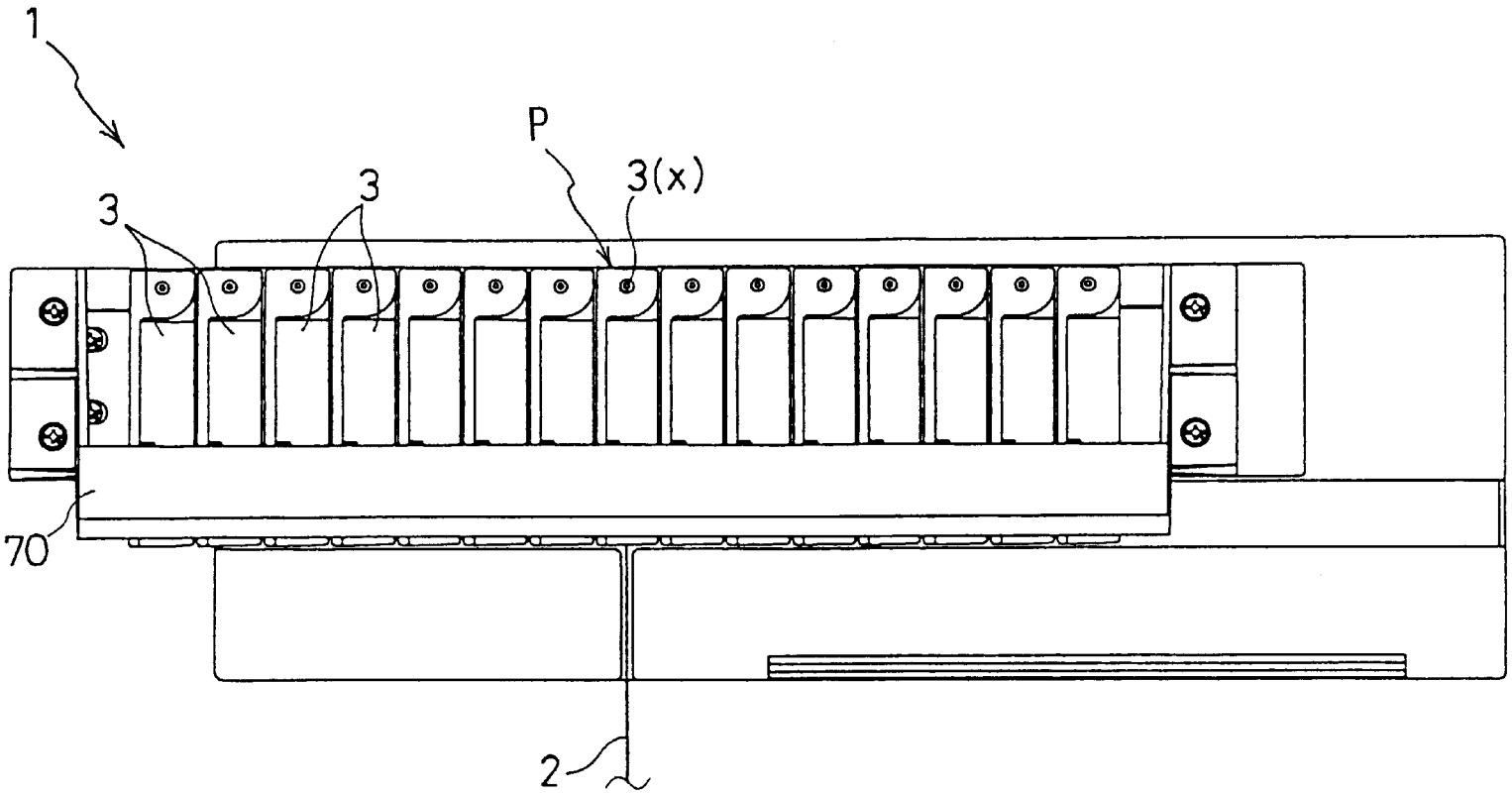
FIG. 1 is a top view of an upper thread changing device, according to an exemplary embodiment of the invention.
Figure 2:
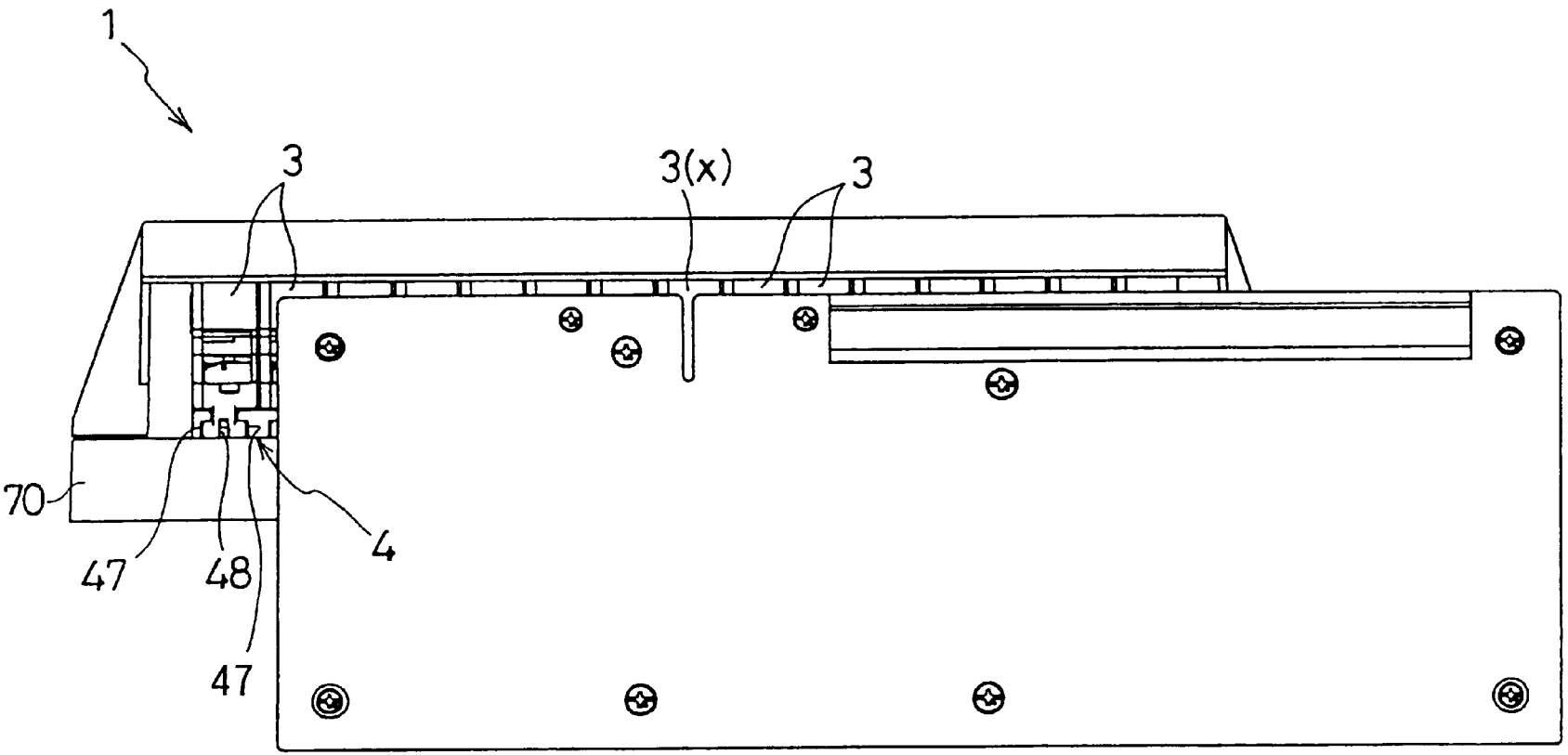
FIG. 2 is a front view of the upper thread changing device.
Figure 3:
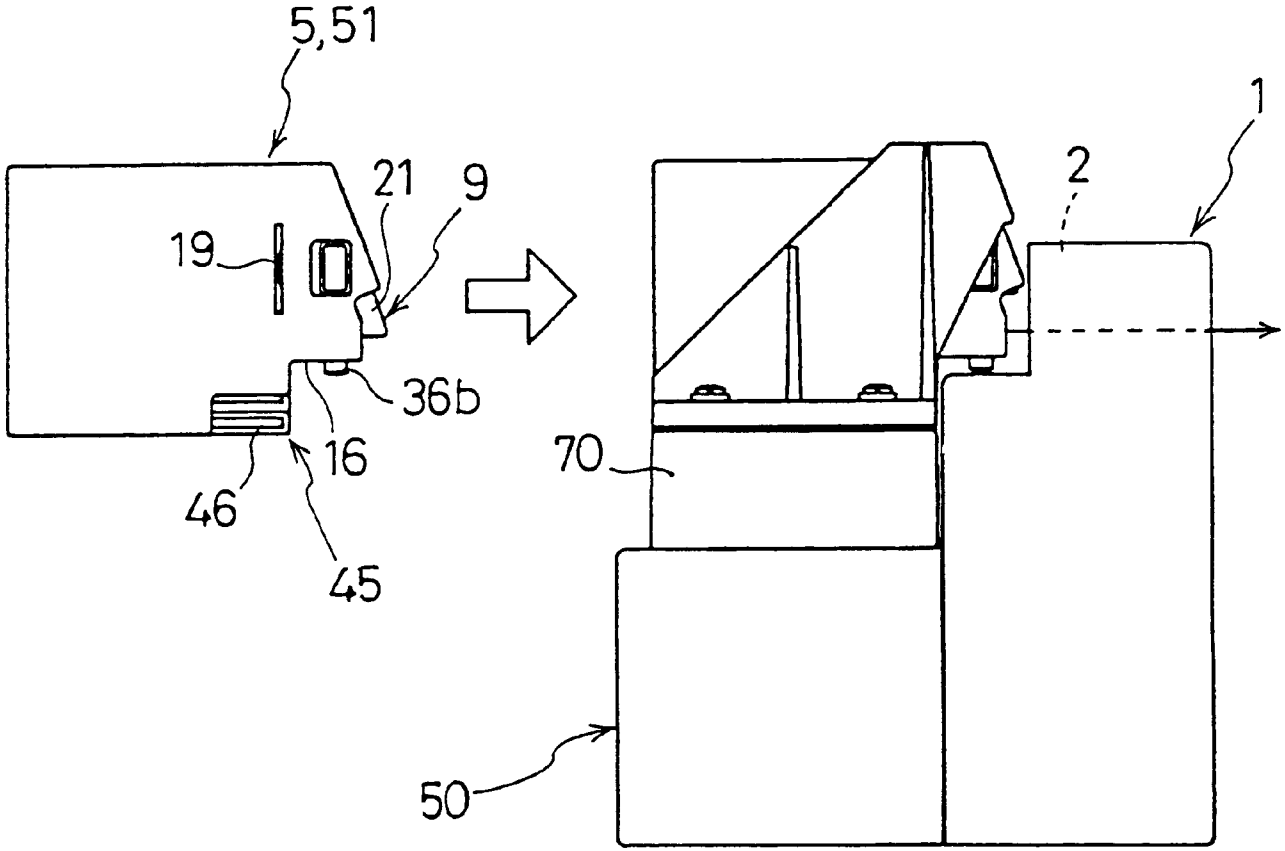
FIG. 3 is a side view of the upper thread changing device.

As shown in FIGS. 1 to 3, the upper thread changing device 1 has a plurality of the upper thread cassettes 3, each of which contains an upper thread 2 of a different color for use in sewing, cassette mounting sections 4 that detachably mount the upper thread cassettes 3 thereon, and a cassette changing mechanism 50 that changes the positions of the cassette mounting sections 4 so that any one of the plurality of the upper thread cassettes 3 mounted on the cassette mounting sections 4 is moved to an upper thread supply position P to supply the upper thread 2 to the sewing machine.

Specific upper thread changing mechanisms of the upper thread changing device 1, which are not main aspects of the invention, will not be described in detail herein. Briefly stated, the upper thread changing device 1 further includes an upper thread cutting mechanism (shown in FIG. 4 and discussed below) that cuts, in the upper thread changing device 1, the upper thread 2 supplied from the upper thread cassette 3 placed in the upper thread supply position P to supply the upper thread 2 to the sewing machine, and a thread connecting mechanism (not shown) that connects an end of the upper thread 2 cut by the upper thread cutting mechanism, and an end of another upper thread 2 that is to be newly supplied from a different upper thread cassette 3 moved to the upper thread supply position P. Using the above-described mechanisms, the upper threads 2 contained in the separate upper thread cassettes 3 may be connected. In the upper thread changing device 1, the upper thread 2 currently being supplied to the sewing machine may be changed to another upper thread 2 contained in a different upper thread cassette 3, and that upper thread 2 may be supplied to the sewing machine.

The upper thread cassette 3 will be described in detail below.

As shown in FIGS. 4 through 8, the upper thread cassette 3 includes a cassette member 5, an upper thread bobbin 6 as a thread wound member, a thread wound member mounting part 7, an outlet 8, a thread cutting mechanism 9, a thread end holding member 10, a tension release operation part 11, a brake mechanism 12, and a brake releasing member 13. The cassette member 5 includes a cassette body 14, and a cassette cover 15 that opens or closes the cassette body 14. The cassette body 14 and the cassette cover 15 are formed of transparent material of synthetic resin, so that the upper thread 2 wound around the upper thread bobbin 6 mounted in the upper thread cassette 3 may be visually identified outside the cassette body 14 or the cassette cover 15.

The cassette body 14 is formed in a substantially rectangular shape as viewed from a side. The cassette body 14 has a stepped portion 16 formed at a corner thereof which comes to a lower side when the upper thread cassette 3 is mounted on the cassette mounting section 4. Formed in the cassette body 14 is an upper thread supplying section 17 including a bobbin receiving hole 18. The upper thread bobbin 6 is disposed in the bobbin receiving hole 18. The upper thread bobbin 6 is also formed of transparent material of synthetic resin, so that the upper thread 2 wound around the upper thread bobbin 6 mounted in the upper thread cassette 3 may be visually identified outside the cassette body 14 or the cassette cover 15.

The upper thread bobbin 6 has a diameter slightly smaller than the diameter of the bobbin receiving hole 18, and a small width, relative to the diameter thereof, as measured in the direction of an axis of the bobbin 6. The bobbin 6 is rotatably mounted on the thread wound member mounting part 7. The mounting part 7 is integrally formed with the cassette body 14 at a substantially central portion of the bobbin receiving hole 18. With the above-described structure of the upper thread bobbin 6, the cassette member 5 may be relatively thin, achieving reductions in the physical size and the weight of the cassette member 5. For additional weight reduction, a plurality of holes 6*a* are formed in the upper thread bobbin 6. The cassette cover 15 is pivotally supported on an end of the cassette body 14, so as to open or close the cassette body 14. The cassette cover 15 is securely closed as an engagement member 19 provided on the cassette cover 15 engages a hook (not shown) of the cassette body 14.

Figure 4:
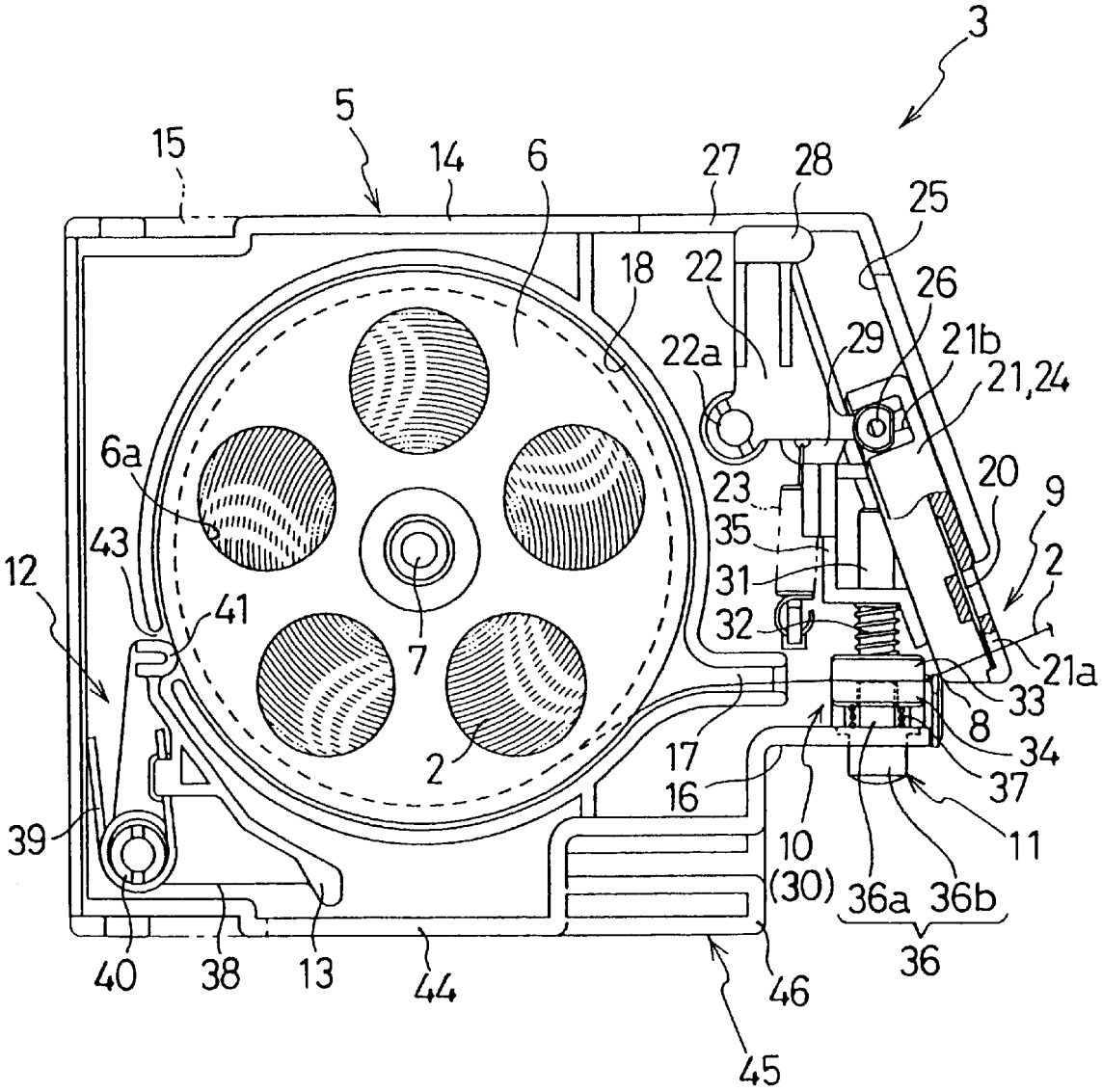
FIG. 4 is a front view of a cassette member illustrating internal structures thereof.

As shown in FIG. 4, the thread cutting mechanism 9 cuts the upper thread 2 supplied from the upper thread bobbin 6 mounted on the thread wound member mounting part 7. The thread cutting mechanism 9 cuts the upper thread 2 such that a cut end of the upper thread 2 protrudes from the thread end holding member 10 by a predetermined length. The thread cutting mechanism 9 includes a cutter blade 20, a blade holder 21 that holds the cutter blade 20, a link member 22 that moves the blade holder 21, and a tensile coil spring 23 that urges the blade holder 21 downwardly.

The blade holder 21 is formed in a substantially box shape into a protective cover 24. The protective cover 24 is movable between an upward position, used when the cassette member 5 is mounted on the upper thread changing device 1, and a downward position, used when the cassette member 5 is not mounted on the upper thread changing device 1, as shown in FIG. 4. More specifically, a protective cover slidable space 25 is provided on the right-side comer of the cassette body 14 as shown in FIG. 4. The protective cover 24 is structured so as to move upwardly or downwardly in the protective cover slidable space 25. When the cassette member 5 is not mounted on the upper thread changing device 1, the protective cover 24 is in the downward position where the protective cover 24 covers the protruding end of the upper thread 2. When the cassette member 5 is mounted on the upper thread changing device 1, the protective cover 24 is in the upward position where the protective cover 24 is moved away from the end of the upper thread 2 into the protective cover slidable space 25.

The cutter blade 20 is held in a lower part of the blade holder 21. When the cassette member 5 is not mounted on the upper thread changing device 1, a lower edge of the cutter blade 20 is partially exposed through a slit 21*a*. Provided in the cassette body 14 is the outlet 8 for leading an end of the upper thread 2, supplied from the upper thread bobbin 6 mounted on the thread wound member mounting part 7, out of the cassette member 5. The thread cutting mechanism 9 is provided near the outlet 8. The end of the upper thread 2 supplied from the upper thread bobbin 6 is led from the cassette member 5, through the outlet 8 and the slit 21*a*. The free end of the upper thread 2 led from the cassette member 5 is manually moved toward the cutter blade 20 to cut the upper thread 2 using the blade 20. Because the upper thread cassette 3 is provided with the cutter blade 20, a pair of scissors or another cutter is not necessary to cut the upper thread 2, improving the thread cutting operation.

The link member 22 is pivotally supported about a supporting pivot 22*a*, near the protective cover slidable space 25 in the cassette body 14. A corner of the link member 22 at the pivot 22*a* is supported by the cassette body 14. A pin 26, provided in an end or a comer of the link member 22, is movably fitted into a recess 21*b* formed on a side of an upper portion of the blade holder 21. A slit 27 is formed on a right upper comer of the cassette body 14 as shown in FIG. 4. When the upper thread cassette 3 is mounted on the cassette mounting section 4, a rib (not shown) provided in the upper thread changing device 1 contacts and pushes an end 28 of the link member 22 while moving along the slit 27.

At the back of the blade holder 21, an end of the tensile coil spring 23 is connected to a bracket 29. The other end of the tensile coil spring 23 is connected to the cassette body 14. When the upper thread cassette 3 is not mounted on the cassette mounting section 4, the blade holder 21 is always kept in the downward position, as shown in FIG. 4, by the urging force of the tensile coil spring 23.

When the upper thread cassette 3 is mounted on the cassette mounting section 4, the rib pushes the end 28 of the link member 22 toward the left side in FIG. 4, causing the link member 22 to turn counterclockwise against the urging force of the tensile coil spring 23. In linkage with the movement of the link member 22, the blade holder 21 is moved upwardly into the protective cover slidable space 25. At this time, the cutter blade 20 is also moved upwardly into the protective cover slidable space 25, together with the blade holder 21. With the cutter blade 20 in the upward position, cutting of the upper thread 2 is infeasible.

As shown in FIG. 4, the thread end holding member 10, provided near the outlet 8, holds an end of the upper thread 2 cut by the thread cutting mechanism 9. The thread end holding member 10 also serves as a tension applying mechanism 30 that applies tension to the upper thread 2 supplied from the upper thread bobbin 6. The tension applying mechanism 30 includes a shaft 31, a pressing pin 36 integrally formed with the shaft 31, compression coil springs 32, 37, and movable plates 33, 34.

Near the blade holder 21 in the cassette body 14, a supporting member 35 is integrally formed with the cassette body 14. The shaft 31, provided in a vertical direction as shown in FIG. 4, is fixed in the supporting member 35 while passing through an opening in the supporting member 35. Provided at a lower end portion of the shaft 31 is the pressing pin 36. The compression coil spring 37 and the movable plate 34 are provided above the pressing pin 36. In addition, the movable plate 33 and the compression coil spring 32 are provided above the compression coil spring 37 and the movable plate 34. The movable plate 33 is urged downwardly by an urging force of the compression coil spring 32. The movable plate 34 is urged upwardly by an urging force of the compression coil spring 37. With this structure, the upper thread 2, supplied from the upper thread bobbin 6, is held between the movable plates 33, 34. Disposed between the movable plate 33 and the compression coil spring 32 provided on the shaft 31 is a retaining ring (not shown). When the shaft 31 is moved upwardly with the pressing pin 36 pressed, the retaining ring prevents the urging force of the compression spring 32 from being transmitted to the movable plate 34.

Figure 5:
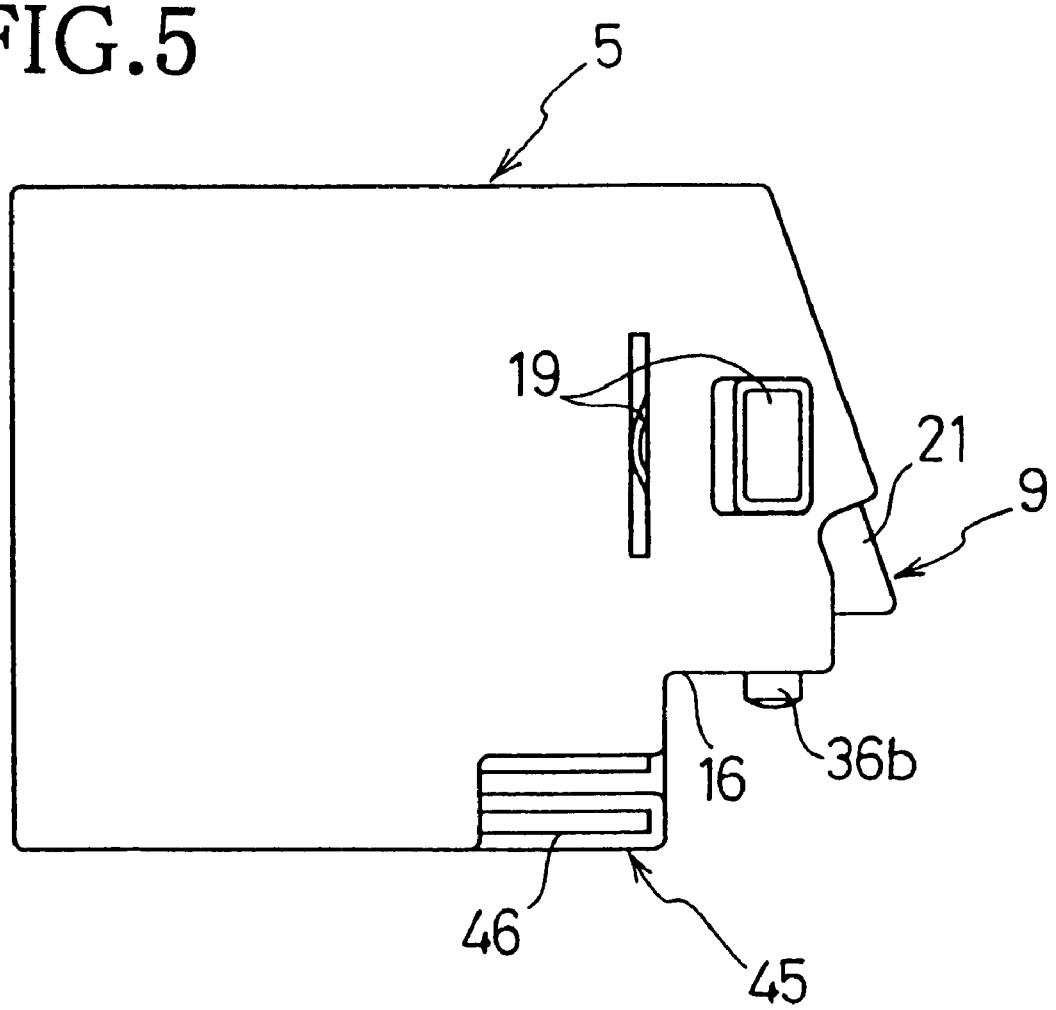
FIG. 5 is a front view of the cassette member with a cassette cover closed.
Figure 6:
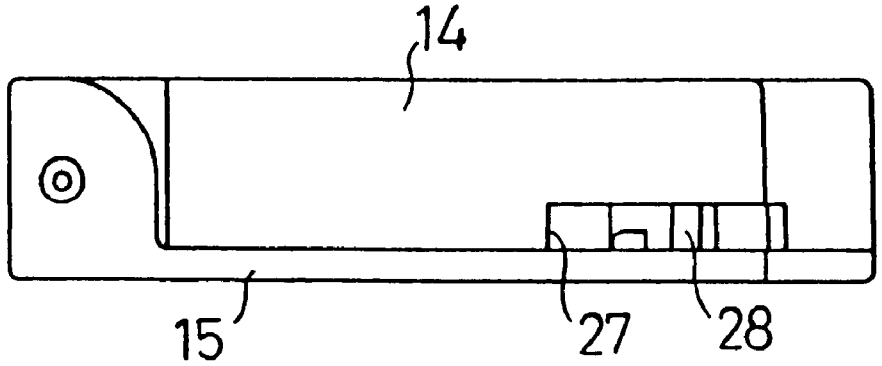
FIG. 6 is a top view of the cassette member.
Figure 7:
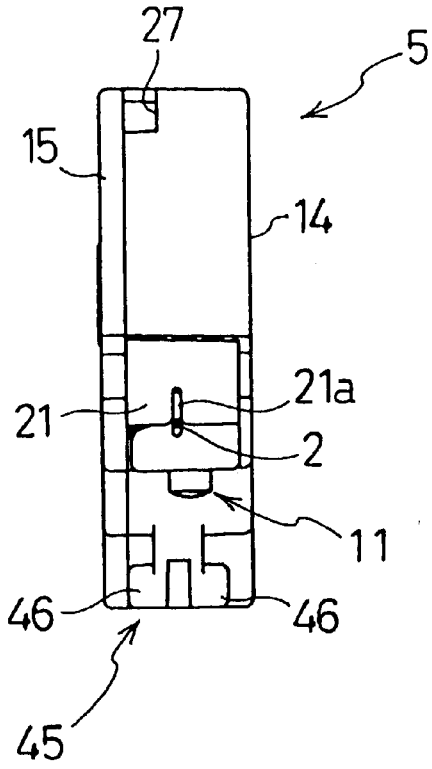
FIG. 7 is a side view of the cassette member viewed from the right.
Figure 8:
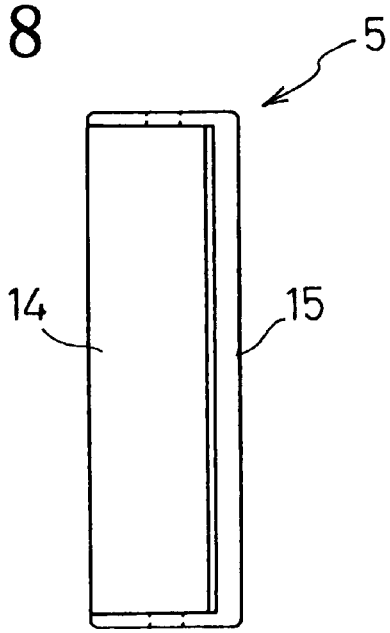
FIG. 8 is a side view of the cassette member viewed from the left.

The tension release operation part 11, shown in FIGS. 4, 5 and 7, is externally operated to release the tension applied to the upper thread 2 by the tension applying mechanism 30. The tension release operation part 11 includes the pressing pin 36 integrally provided with the shaft 31 and the compression coil spring 37. The pressing pin 36 has a smaller diameter portion 36*a* formed in an upper half of the pin 36 and a larger diameter portion 36*b* formed in a lower half of the pin 36. The pressing pin 36 slidably moves in an upward or downward direction. The smaller diameter portion 36*a* passes through a hole formed on the movable plate 34 in the cassette body 14.

The larger diameter portion 36*b* has a flange formed at an upper portion thereof. The compression spring 37 whose urging force is smaller than that of the compression spring 32 of the tension applying mechanism 30 is disposed between the flange and the movable plate 34. When the upper thread cassette 3 is not mounted on the cassette mounting section 4, the tension applied by the tension applying mechanism 30 is maintained by urging the movable plate 33 downwardly with the urging force of the compression spring 32 to press the movable plate 33 against the movable plate 34. When the upper thread cassette 3 is mounted on the cassette mounting section 4, the larger diameter portion 36*b*, whose greatest part extends downwardly from the cassette body 14, makes contact with a cam (not shown) of the upper thread changing device 1, causing the pressing pin 36 to move upwardly, against the urging force of the compression spring 32. Accordingly, the movable plate 33 is moved upwardly. When the movable plate 33 is pushed upwardly to a raised position, the urging force of the compression spring 32 in the downward direction is not transmitted to the movable plate 34 by the retaining ring (not shown), which is provided between the movable plate 33 and the compression coil spring 32.

The brake mechanism 12 that applies a brake to the upper thread bobbin 6, mounted on the thread wound member mounting part 7, will be described below. As shown in FIG. 4, the brake mechanism 12 includes a brake body 38 and a torsion spring 39. At the lower left comer of the cassette body 14, as shown in FIG. 4, the brake body 38 is pivotally supported by a pivot shaft 40. The brake body 38 has generally a triangular shape and is pivotally supported about a comer thereof. Formed at another comer of the brake body 38 is a rotation controlling member 41 that controls the rotation of the upper thread bobbin 6. Formed at the other comer of the brake body 38 is the brake releasing member 13 that is pushed, when the upper thread cassette 3 is mounted on the upper thread changing device 1, by an guiding part 48 (see FIG. 2) provided in the device 1.

The torsion spring 39 is fitted over the pivot shaft 40, with an end thereof coupled to the brake body 38 and the other end making contact with an inner wall of the cassette body 14. When the upper thread cassette 3 is not mounted on the cassette mounting section 4, the brake body 38 is urged by the torsion spring 39 in a clockwise direction as shown in FIG. 4. The rotation controlling member 41 contacts an outer edge of the upper thread bobbin 6, through a notch 43 in the bobbin receiving hole 18, applying the brake to the upper thread bobbin 6. Formed in the lower wall of the cassette body 14 is a slit 44. When the upper thread cassette 3 is mounted on the cassette mounting section 4, the guiding part 48 provided in the upper thread changing device 1 passes through the slit 44 and eventually pushes the brake releasing member 13. More specifically, the brake releasing member 13 is pushed upwardly by the guiding part 48, against the urging force of the torsion spring 39, thereby moving the rotation controlling member 41 away from the upper thread bobbin 6. Thus, the brake applied by the rotation controlling member 41 may be released.

A guide section 45 of the upper thread cassette 3 will be described below. As shown in FIGS. 2, 4, 5 and 7, provided at the right-side lower comer of the cassette body 14, as shown in FIG. 4, is the guide section 45 that guides the installation of the upper thread cassette 3 onto the upper thread changing device 1. The guide section 45 has a pair of rectangular guides 46. The guides 46 are provided on both sides of the upper thread cassette 3 in the direction of the width thereof, in parallel to each other with a predetermined distance therebetween. As shown in FIG. 2, the cassette mounting section 4 includes a pair of guiding parts 47, each having a generally "L"-shaped cross-section, and another guiding part 48 having a generally "I"-shaped cross-section. The upper thread cassette 3 is mounted on the cassette mounting section 4 by engaging guides 46 with the guiding parts 47 and by inserting a space between the guides 46 over the guiding part 48.

The cassette changing mechanism 50 will be described below. As shown in FIGS. 1 through 3, a movable member 70 having a plurality of the cassette mounting sections 4 is movably supported in the upper thread changing device 1. The movable member 70 is driven by the cassette changing mechanism 50, so as to move to the right and left in the FIG. 1. More specifically, the upper thread changing device 1 includes a straight guiding mechanism, and a drive motor or an actuator (all of which are not shown). The drive motor or the actuator is driven by a drive controller (not shown) to change the positions of cassette mounting sections 4, so that an upper thread cassette 3(X) containing the upper thread 2 of the desired color is placed in the upper thread supply position P to supply the upper thread 2 to the sewing machine.

The operation of the upper thread cassette 3 will be described below. At the time when the upper thread cassette 3 is not mounted on the cassette mounting section 4 of the upper thread changing device 1, the upper thread bobbin 6 winding the upper thread 2 thereon is mounted on the thread wound member mounting part 7 so as to fit the bobbin 6 into the bobbin receiving hole 18 of the cassette body 14. An end of the upper thread 2 is supplied from the upper thread bobbin 6 and is directed between the movable plates 33, 34 through the upper thread supplying section 17, to the outlet 8. The end of the upper thread 2 is led out of the cassette member 5 from the outlet 8 through the slit 21*a*. Thereafter, the cassette cover 15 is closed and the end of the upper thread 2 is manually moved toward the cutter blade 20 to cut the upper thread 2.

At this time, the upper thread 2 is held by the thread end holding member 10, with the cut end of the upper thread 2 protruding by a predetermined length from the outlet 8. The protective cover 24 covers the end of the upper thread 2 while being kept in the downward position, as shown in FIG. 4, when the upper thread cassette 3 is not mounted on the cassette mounting section 4. Because the protective cover 24 covers the end of the upper thread 2, the thread end protruding from the outlet 8 is prevented from being touched by, for example, a user. Therefore, the protruding thread end is not bent or curved. The brake mechanism 12 applies the brake to the upper thread bobbin 6 to prevent the bobbin 6 from rotating, such as when the upper thread bobbin 6 does not have to supply the upper thread 2.

When the upper thread cassette 3 is mounted on the cassette mounting section 4, the rib of the upper thread changing device 1 presses the end 28 of the link member 22, causing the link member 22 to pivotally move in the counterclockwise direction, as shown in FIG. 4, against the urging force of the tensile coil spring 23. In association with the movement of the link member 22, the protective cover 24 is moved upwardly into the protective cover slidable space 25. As the protective cover 24 is moved upwardly when the upper thread cassette 3 is mounted on the cassette mounting section 4, the upper thread changing operation may be smoothly performed by the upper thread changing device 1, without being interfered with by the protective cover 24. When the protective cover 24 is in the upward position, the cutter blade 20 is also moved into the protective cover slidable space 25, so that the upper thread 2 can not be cut by the cutter blade 20.

When the pressing pin 36 of the tension release operation part 11 contacts the cam of the upper thread changing device 1, the pressing pin 36 is moved upwardly against the urging force of the compression coil springs 32, so that the movable plate 33 is pushed upwardly. At this time, the urging force of the compression coil spring 32 is not transmitted to the movable plate 33. Accordingly, the holding force between the movable plates 33, 34 is reduced. Thus, the tension applied to the upper thread 2 by the tension applying mechanism 30 is released.

As the brake releasing member 13 is pushed upwardly by guiding part 48 of the upper thread changing device 1, against the urging force of the torsion spring 39, the rotation controlling member 41 moves away from the upper thread bobbin 6. Thus, the upper thread bobbin 6 is set free from the rotation controlling member 41. By operating the brake releasing member 13 outside the cassette member 5, the brake applied by the brake mechanism 12 may be released.

As shown in FIGS. 1 and 2, a plurality of the upper thread cassettes 3, each of which contains an upper thread 2 of a different color, are mounted on the cassette mounting sections 4. The cassette changing mechanism 50 changes the positions of the cassette mounting sections 4, so that any one of the upper thread cassettes 3 mounted on the cassette mounting sections 4 is moved to the upper thread supply position P to supply the upper thread 2 to the sewing machine. Thereafter, upper thread changing operations to supply the upper thread 2 from the selected upper thread cassette 3 are performed before starting sewing operations.

In the above-described upper thread cassette 3, the thread cutting mechanism 9 cuts the upper thread 2 supplied from the upper thread bobbin 6 mounted on the thread wound member mounting part 7. The upper thread 2 cut by the thread cutting mechanism 9 is held by the thread end holding member 10, with a cut end thereof protruding from the outlet 8 by a predetermined length. Therefore, an end of the upper thread 2 does not have to be pulled out and set to the predetermined length every time the upper thread cassettes 3 are mounted on the upper thread changing device 1. Accordingly, the operation of changing the colors of the upper threads 2 during the sewing operations are facilitated. In addition, the structure of the upper thread cassette 3 facilitates the upper thread changing operation for changing the color of the upper threads 2 to be automatically conducted by the upper thread changing device 1. Further, the upper thread 2 can be prevented from unintentionally being released from the thread end holding member 10, being tangled, or being pulled into the upper thread cassette 3.

The thread end holding member 10 and the thread cutting mechanism 9 are provided adjacent to the outlet 8. Therefore, the upper thread 2 may be cut by the thread cutting mechanism 9 with an end thereof protruding outwardly from the cassette member 5, while preventing slack in the upper thread 2 or the entanglement thereof. The upper thread bobbin 6 has a small width provided in the direction of the axis thereof, relative to its diameter. Thus, the cassette member 5 is relatively thin, achieving the reductions in the physical size and the weight of the cassette member 5.

The brake is applied to the upper thread bobbin 6 by the brake mechanism 12 to prevent the upper thread bobbin 6 from rotating, such as when the upper thread bobbin 6 does not have to supply the upper thread 2. Accordingly, the slack in the upper thread 2 or the entanglement thereof in the upper thread cassette 3 is prevented. The brake applied by the brake mechanism 12 is readily released by operating the brake releasing member 13 outside the cassette member 5.

The cassette member 5 and the upper thread bobbin 6 are formed of transparent material, so that the color and a remaining amount of the upper thread 2 wound around the upper thread bobbin 6 may be visually identified outside the cassette member 5 and the upper thread bobbin 6. Therefore, it is very convenient to check the color or the remaining amount of the upper thread 2 wound around the upper thread bobbin 6.

In the above-described upper thread changing device 1, a plurality of the upper thread cassettes 3 are mounted on the cassette mounting sections 4. The cassette changing mechanism 50 changes the positions of the cassette mounting sections 4, so that any one of the plurality of the upper thread cassettes 3, for example, the upper thread cassette 3(X) mounted on one of the cassette mounting sections 4 is placed in the upper thread supply position P, as shown in FIG. 1. Thus, the desired color of the upper thread 2 contained in, for example, the upper thread cassette 3(X) may be readily supplied to the sewing machine. Because a reduction in the size of the upper thread cassette 3 is achieved, the size of the upper thread changing device 1 is also reduced.

An upper thread cassette 3A according to a modification of the exemplary embodiment will be described below. It is to be noted that similar reference numerals denote similar elements.

Figure 9:
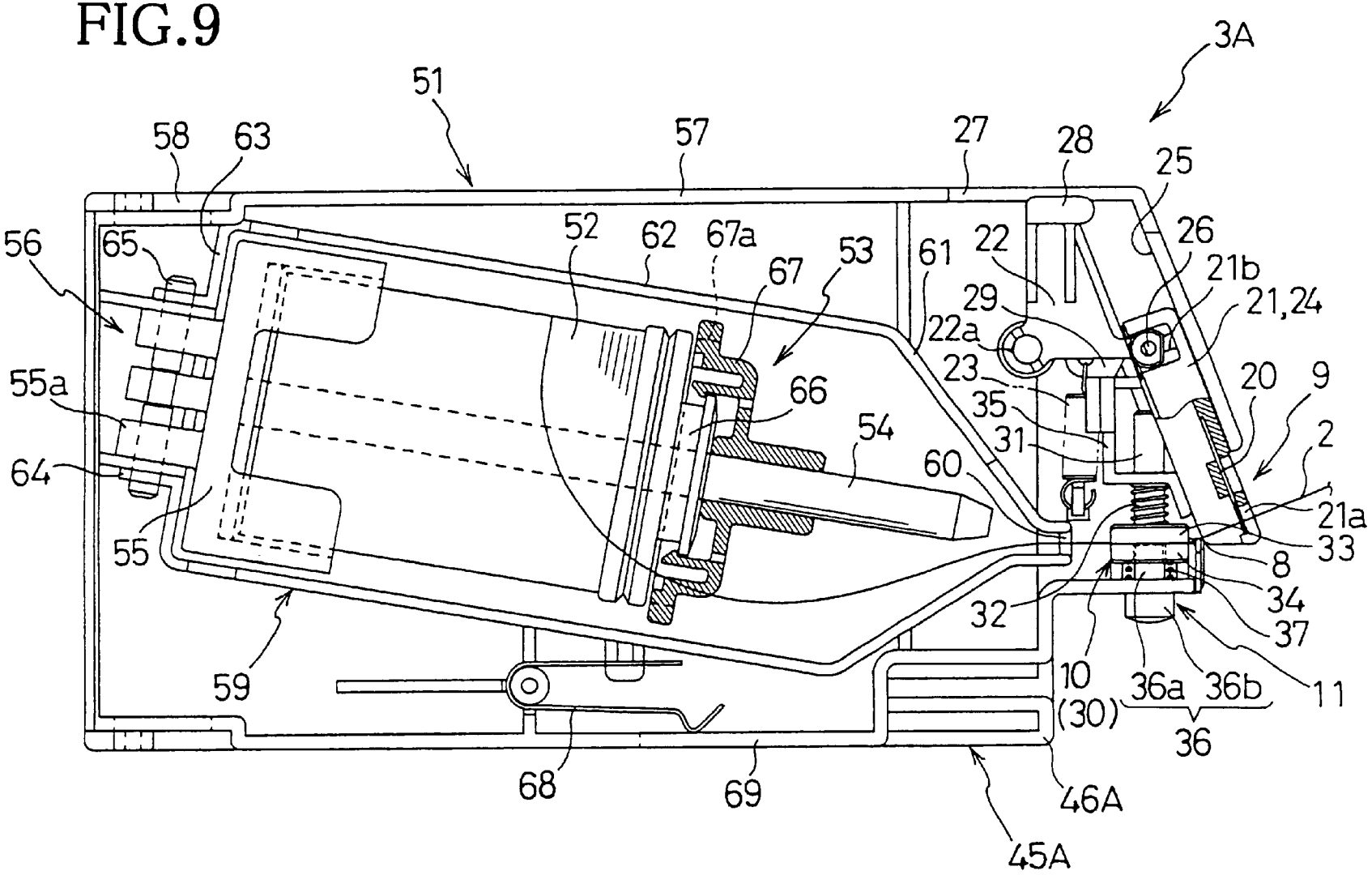
FIG. 9 is a front view of a cassette member according to a modification of the exemplary embodiment, illustrating internal structures thereof.

As shown in FIGS. 9 through 1, the upper thread cassette 3A includes a cassette member 51, a thread spool 52 as a thread wound member, a thread spool presser 53, a supporting shaft 54, a shaft supporting member 55, and a connecting mechanism 56. Further, the upper thread cassette 3A has an outlet 8, a thread cutting mechanism 9, a thread end holding member 10 (a tension applying mechanism 30), and a tension release operation part 11 having the same structures as described in the above exemplary embodiment. The upper thread cassette 3A according to the modification of the exemplary embodiment is not provided with the brake mechanism 12 and the brake releasing member 13.

The cassette member 51 includes a cassette body 57 and a cassette cover 58. The cassette body 57 and the cassette cover 58 are formed of transparent material of synthetic resin. Therefore, the upper thread 2 wound around the thread spool 52, which is set in the cassette member 51, can be visually identified. A thread spool accommodating portion 59 is formed at an angle in the cassette body 57. The thread spool 52 is accommodated in the thread spool accommodating portion 59. The width of the cassette body 57 is approximately twice as thick as the width of the cassette body 14 in the above-described exemplary embodiment. The thread spool accommodating portion 59 includes an upper thread supplying section 60, a tapered portion 61, a straight portion 62, a rear end wall 63, and a flange 64, in this order from the right end of the thread spool accommodating portion 59, as shown in FIG. 9.

Figure 10:
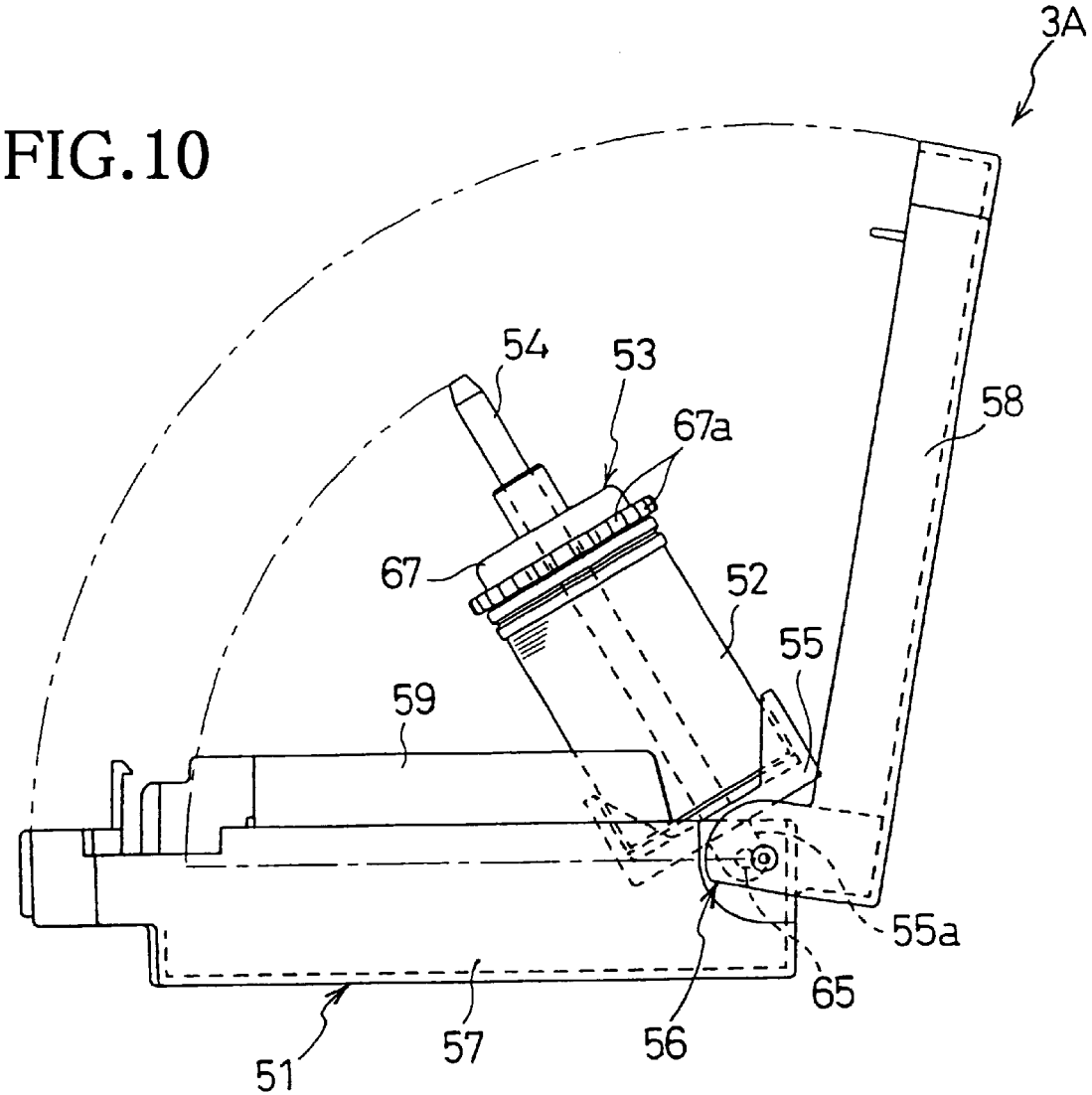
FIG. 10 is a plan view of the cassette member according to the modification of the exemplary embodiment, with a cassette cover open.
Figure 11:
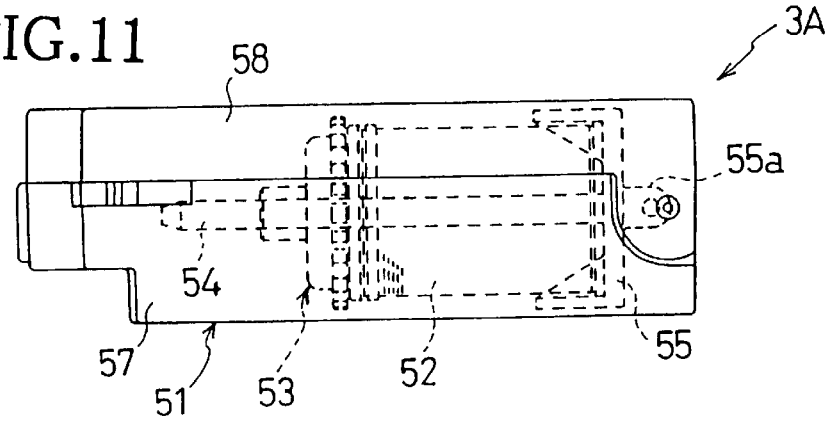
FIG. 11 is a top view of the cassette member according to the modification of the exemplary embodiment, including a thread spool therein.
Figure 12:
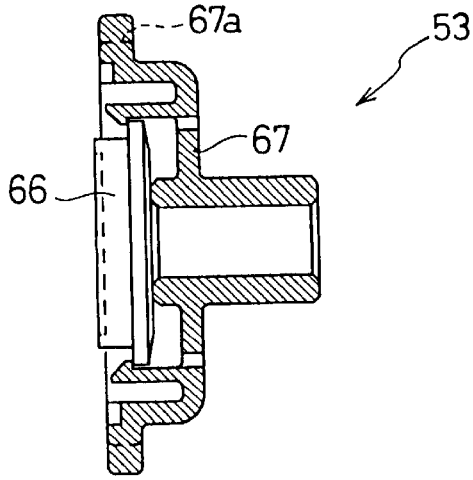
FIG. 12 is a vertical sectional view of a thread spool presser.
Figure 13:
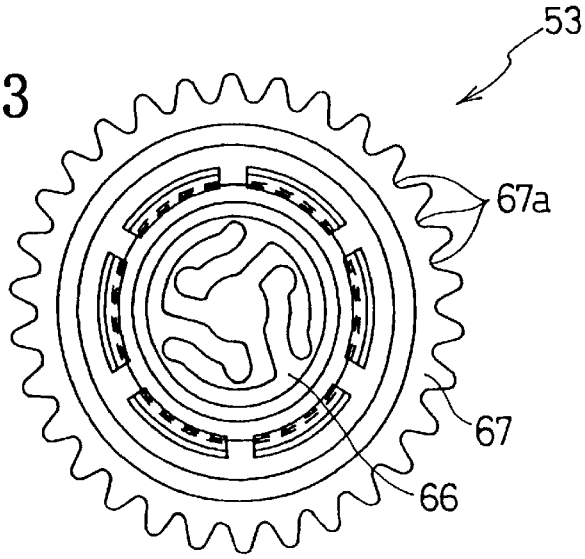
FIG. 13 is a front view of the thread spool presser.

As shown in FIG. 9, the supporting shaft 54 and the shaft supporting member 55 are connected to the flange 64, through the connecting mechanism 56, so as to integrally pivot. More specifically, the shaft supporting member 55 is connected to the flange 64 of the cassette body 57 by a bracket 55*a*, and secures the supporting shaft 54 at an end thereof. The shaft supporting member 55 and the supporting shaft 54 correspond to the thread wound member mounting part 7 in the above exemplary embodiment. The connecting mechanism 56 includes the flange 64, the bracket 55*a*, and a pin 65 that connects the flange 64 and the bracket 55*a*. The shaft supporting member 55 and the supporting shaft 54 are connected to the cassette member 51, so as to pivot in a range between a thread spool accommodating position and a thread spool changing position. The thread spool accommodating position is a position where the thread spool 2 is accommodated inside the cassette member 51, as shown in FIGS. 9 and 11. The thread spool changing position is a position where the supporting shaft 54 is pivoted, as the cassette cover 58 is opened, from the thread spool accommodating position to a position in which the supporting shaft 54 is kept at an angle, so as to enable the exchange of the thread spool 52, as shown in FIG. 10.

As shown in FIGS. 9, 10, 12, and 13, the thread spool presser 53 that presses the thread spool 52 supported by the supporting shaft 54 is removable from the supporting shaft 54. The thread spool presser 53 includes a fixed part 66 that is fixed on the supporting shaft 54, and a movable part 67 that moves relative to the fixed part 66. A plurality of guide grooves 67*a* are formed on an outer edge of the movable part 67. A plate spring 68 (FIG. 9) is provided in the cassette body 57 below the thread spool accommodating portion 59. When the upper thread cassette 3A is mounted on the cassette mounting section 4, a rib (not shown) of the upper thread changing device 1 passes through a slit 69, pushing the plate spring 68.

Operation of the upper thread cassette 3A structured as described above will now be explained. The cassette cover 58 is first opened. The supporting shaft 54 and the shaft supporting member 55 are then pivotally moved to the thread spool changing position by the connecting mechanism 56. The thread spool 52 is then set on the supporting shaft 54 while at the thread spool changing position. The thread spool presser 53 is mounted on the shaft 54, so as to press down the thread spool 52. The upper thread 2, wound around the thread spool 52, is led out of the outlet 8 and through the tension applying mechanism 30. The upper thread 2 led out of the outlet 8 is then cut using the thread cutting mechanism 9, such that a cut end of the upper thread 2 protrudes from the outlet 8 by a predetermined length. The end of the upper thread cut by thread cutting mechanism 9 is held by the thread end holding member 10. The supporting shaft 54 and the shaft supporting member 55 are then pivotally moved together with the thread spool 52, which is supported by the supporting shaft 54, to the thread spool accommodating position by the connecting mechanism 56. Thereafter, the cassette cover 58 is closed. The upper thread cassette 3A may be used for sewing operations similar to the above-described exemplary embodiment, by setting the cassette 3A onto the cassette mounting section 4. As the upper thread 2 is supplied from the upper thread cassette 3A to the sewing machine, the upper thread 2 supplied from the thread spool 52 is guided by one of the guide grooves 67*a* formed on the thread spool presser 53.

In the upper thread cassette 3A, commercially available thread spools generally for home-use sewing machines may be used as thread wound members. The supporting shaft 54 and the shaft supporting member 55 are pivotally moved, with the connecting mechanism 56, to the thread spool changing position where the thread spool 52 may be set onto and supported by the supporting shaft 54. The supporting shaft 54 and the shaft supporting member 55 are then pivotally moved together with the thread spool 52, supported by the supporting shaft 54, to the thread spool accommodating position with the connecting mechanism 56. Thus, the thread spools 52 may be readily changed. The upper thread 2 supplied from the thread spool 52 is guided by one of the guide grooves 67*a* of the thread spool presser 53 so that the upper thread 2 may be stably supplied from the thread spool 52. In addition, the upper thread 2 is prevented from getting twisted, entangled, or overlapped, inside the upper thread cassette 3A due to slack in the upper thread 2. Further, similar effects or advantages as those described in the above exemplary embodiment may be obtained.

Although the invention has been described with reference to the exemplary embodiment, it is to be understood that the invention is not restricted to the particular forms shown in the foregoing exemplary embodiments. Various modifications and alterations can be made thereto without departing from the scope of the invention, as set forth in the appended claims.

For example, the upper thread cassette 3, 3A is mounted on the upper thread changing device 1 in the exemplary embodiments. However, the upper thread cassette 3, 3A may be mounted at an appropriate position on an arm of a sewing machine.

Although the guide section 45, 45A of the upper thread cassette 3, 3A in the foregoing exemplary embodiments guides the installation of the upper thread cassette 3, 3A onto the upper thread changing device 1, the guide section 45, 45A may be employed for guiding the installation of the upper thread cassette 3, 3A onto a sewing machine.

In the modification of the second exemplary embodiment, the thread spool 52 is fixedly supported by the supporting shaft 54 while supplying the upper thread 2 wound therearound. However, the thread spool 52 may supply the upper thread 2 wound therearound while being rotatably supported by the supporting shaft 54.

What is claimed is:

1. An upper thread cassette that contains an upper thread for use in sewing, comprising:

a cassette member that includes a cassette and a cassette cover that opens or closes the cassette body;

a thread wound member mounting part that mounts thereon a thread wound member winding the upper thread therearound, the thread wound member mounting part being provided inside the cassette member; and a cutting mechanism that cuts the upper thread supplied from the thread wound member mounted on the thread wound member mounting part.

2. The upper thread cassette according to claim 1, further comprising a thread end holding member that holds an end of the upper thread cut by the cutting mechanism.

3. The upper thread cassette according to claim 2, wherein the cutting mechanism cuts the upper thread such that a cut end of the upper thread protrudes from the thread end holding member by a predetermined length.

4. The upper thread cassette according to claim 2, wherein the cassette member has an outlet that leads the end of the upper thread supplied from the thread wound member mounted on the thread wound member mounting part outside the cassette member, and the thread end holding member and the cutting mechanism are provided near the outlet.

5. The upper thread cassette according to claim 1, further comprising a tension applying mechanism that applies tension to the upper thread supplied from the thread wound member mounted on the thread wound member mounting part.

6. The upper thread cassette according to claim 5, further comprising a tension release operation part that releases the tension applied by the tension applying mechanism by external operation of the tension applying mechanism.

7. The upper thread cassette according to claim 5, wherein the thread end holding member serves as the tension applying mechanism.

8. The upper thread cassette according to claim 1, wherein the thread wound member to be mounted on the thread wound member mounting part includes an upper thread bobbin having a narrow width provided in a direction of an axis thereof relative to a diameter of the upper thread bobbin, and the thread wound member mounting part rotatably mounts the upper thread bobbin thereon.

9. The upper thread cassette according to claim 8, further comprising a brake mechanism that applies a brake to the upper thread bobbin mounted on the thread wound member mounting part.

10. The upper thread cassette according to claim 9, further comprising a brake releasing member that releases the brake applied by the brake mechanism by operating the brake mechanism from outside the cassette member.

11. The upper thread cassette according to claim 8, wherein the cassette member and the upper thread bobbin are partially or totally formed of transparent material that enables the upper thread wound around the upper thread bobbin set in the upper thread cassette to be visually identified.

12. The upper thread cassette according to claim 1, wherein the thread wound member mounted on the thread wound member mounting part includes a thread spool.

13. The upper thread cassette according to claim 12, further comprising:

a supporting shaft that pivotally supports the thread spool, the supporting shaft being provided inside the cassette member;

a shaft supporting member that fixedly supports the supporting shaft at an end thereof, the shaft supporting member being provided inside the cassette member; and a connecting mechanism that connects the shaft supporting member and the supporting shaft to the cassette member so as to allow the shaft supporting member and the supporting shaft to pivot in a range between a thread spool accommodating position where the thread spool is accommodated inside the cassette member, and a thread spool changing position where the supporting shaft is pivoted, as the cassette cover is opened, from the thread spool accommodating position to a position in which the supporting shaft is kept at an angle so as to enable the thread spool to be exchanged.

14. The upper thread cassette according to claim 13, further comprising a thread spool presser that is removably provided so as to press the thread spool pivotally supported by the supporting shaft; and wherein the thread spool presser has a plurality of guide grooves that guide the upper thread and are formed on an outer edge of the thread spool presser.

15. The upper thread cassette according to claim 14, wherein the thread spool presser includes a fixed part that is fixed on the supporting shaft and a movable part that is supported so as to move relative to the fixed part, and the plurality of the guide grooves are formed on an edge of the movable part.

16. The upper thread cassette according to claim 1, wherein the cassette member is partially or totally formed of transparent material that enables the upper thread wound around the thread wound member set in the upper thread cassette to be visually identified.

17. The upper thread cassette according to claim 16, wherein the cassette body is formed of synthetic resin material.

18. The upper thread cassette according to claim 1, wherein the upper thread cassette is mountable to an upper thread changing device that selectively supplies upper threads of a plurality of colors for embroidering.

19. The upper thread cassette according to claim 1, wherein the upper thread cassette is mountable to a position on an arm of a sewing machine.

20. The upper thread cassette according to claim 1, wherein the cassette cover opens the cassette body in order that the thread wound member can be taken away through an opening of the cassette body made by a movement of the cassette cover.

21. An upper thread cassette according to claim 1, the upper thread cassette being detachably mounted on a sewing machine or an upper thread changing device for selectively supplying upper threads of a plurality of colors for sewing, comprising:

a cassette member that includes a cassette body and a cassette cover that opens or closes the cassette body;

a thread wound member mounting part that mounts thereon a thread wound member winding an upper thread therearound, the thread wound member mounting part being provided inside the cassette member;

an outlet that leads an end of the upper thread supplied from the thread wound member mounted on the thread wound member mounting part outside the cassette member, the outlet being provided in the cassette member; and a thread end holding member that holds an end of the upper thread cut by the cutting mechanism, wherein the cutting mechanism that cuts the upper thread supplied from the thread wound member such that the cut end of the upper thread protrudes from the outlet by a predetermined length.

22. The upper thread cassette according to claim 21, wherein the cassette member includes a protective cover movable between a cassette mounted position where the cassette member is mounted on the sewing machine or the upper thread changing device and a cassette non-mounted position where the cassette member is not mounted on the sewing machine or the upper thread changing device, and wherein in the cassette non-mounted position the protective cover covers the cut end of the upper thread that is protruded, and in the cassette mounted position the protective cover moves away from the cut end of the upper thread.

23. The upper thread cassette according to claim 22, wherein the cutting mechanism includes a cutter blade and a holder that holds the cutter blade, and the holder forms the protective cover.

24. An upper thread changing device that selectively supplies to a sewing machine upper threads of a plurality of colors for embroidering, comprising:

a plurality of upper thread cassettes, each of the upper thread cassettes containing an upper thread of different color;

cassette mounting sections that detachably mount the plurality of the upper thread cassettes thereon; and a changing mechanism that changes positions of the cassette mounting sections so as to place any one of the plurality of the upper thread cassettes mounted on the cassette mounting sections to an upper thread supply position to supply the upper thread to the sewing machine.

25. The upper thread changing device according to claim 24, wherein the upper thread cassette includes:

a cassette member that includes a cassette body and a cassette cover that opens or closes the cassette body;

a thread wound member mounting part that mounts thereon a thread wound member winding the upper thread therearound, the thread wound member mounting part being provided inside the cassette member;

a cutting mechanism that cuts the upper thread supplied from the thread wound member mounted on the thread wound member mounting part; and a thread end holding member that holds an end of the upper thread cut by the cutting mechanism.

26. An upper thread cassette that is detachably mounted on a sewing machine or an upper thread changing device for selectively supplying upper threads of a plurality of colors for sewing, comprising:

a cassette member that includes a cassette body and a cassette cover that opens or closes the cassette body;

a thread wound member mounting part that rotatably and detachably mounts thereon a thread wound member winding an upper thread therearound, the thread wound member mounting part being provided inside the cassette member;

a rotation controlling member that controls rotation of the thread wound member; and a contacted part that makes contact with a contact part provided in the sewing machine or the upper thread changing device, wherein the rotation controlling member allows the thread wound member to rotate as the contacted part makes contact with the contact part when the cassette member is mounted on the sewing machine or the upper thread changing device, and the rotation controlling member prevents the thread wound member from rotating when the cassette member is not mounted on the sewing machine or the upper thread changing device.

27. The upper thread cassette according to claim 26, wherein the cassette member includes a guide section that guides an installation of the upper thread cassette onto the sewing machine or the upper thread changing device.

28. An upper thread cassette that is detachably mounted on a sewing machine or an upper thread changing device for selectively supplying upper threads of a plurality of colors for sewing, comprising:

a cassette member that includes a cassette body and a cassette cover that opens or closes the cassette body;

a thread wound member mounting part that mounts thereon a thread wound member winding an upper thread therearound, the thread wound member mounting part being provided inside the cassette member;

an outlet that leads an end of the upper thread supplied from the thread wound member outside the cassette member to supply the upper thread to the sewing machine or the upper thread changing device; and a tension applying mechanism that applies tension to the upper thread supplied from the thread wound member, wherein the tension applying mechanism is a thread holding member that is provided near the outlet and holds the upper thread led through the outlet.

29. The upper thread cassette according to claim 28, wherein the thread holding member serves as a thread end holding member that holds the end of the upper thread led through the outlet.

30. The upper thread cassette according to claim 28, further comprising a tension release operation part that releases the tension applied by the tension applying mechanism by externally operating the tension applying mechanism.

* * * * *